United States Patent [19]

Cleary

[11] 4,059,309

[45] Nov. 22, 1977

[54] APPARATUS AND METHOD FOR CUTTING ELONGATED SLOTS IN EARTH FORMATIONS

[76] Inventor: James M. Cleary, 92 McCallum Drive, Falmouth, Mass. 02541

[21] Appl. No.: 604,055

[22] Filed: Aug. 12, 1975

Related U.S. Application Data

[63] Continuation-in-part of Ser. No. 461,301, April 16, 1974, Pat. No. 3,917,349, and Ser. No. 519,648, Oct. 31, 1974, abandoned.

[51] Int. Cl.[2] ..... E21C 47/00

[52] U.S. Cl. ..... 299/18; 299/19; 299/66; 299/81

[58] Field of Search ..... 299/15, 44, 65, 66, 299/81, 10, 18, 19

[56] References Cited

U.S. PATENT DOCUMENTS

| | | | |
|---|---|---|---|
| 2,253,941 | 8/1941 | Pray | 299/65 X |
| 2,304,143 | 12/1942 | Bigelow | 299/81 |
| 3,792,906 | 2/1974 | Kuck | 299/18 X |
| 3,892,442 | 7/1975 | Janssen | 299/12 X |

*Primary Examiner*—Ernest R. Purser
*Assistant Examiner*—William F. Pate, III

[57] ABSTRACT

An apparatus for cutting a deep slot, having a large depth to thickness ratio, in earth formations, which includes two main components, a motive means and a cutting assembly; the motive means, such as a crawler tractor, supports the projecting end of the cutting assembly, supplies a small portion of the driving force needed to advance the cutting assembly, and provides, through various connections, power, control functions, and the fluids required for operation of the cutting assembly; and the cutting assembly, extending the full depth of the slot along its advancing edge, includes an elongated support, a reciprocating cutter bar mounted on the leading edge of the support, a passage incorporated in the support for transmitting a fluid, generally a high gel strength clay paste, along the support and discharging the fluid in the interior of the slot, in a sufficient amount and under sufficient pressure to resist the earth pressure tending to close the slot and to provide a major portion of the force necessary to move the cutting assembly forward against the advance edge of the slot.

11 Claims, 31 Drawing Figures

APPARATUS AND METHOD FOR CUTTING ELONGATED SLOTS IN EARTH FORMATIONS

CROSS-REFERENCES TO RELATED APPLICATIONS

The present invention is a continuation-in-part of application Ser. No. 461,301, filed Apr. 16, 1974, now issued as U.S. Pat. No. 3,917,349, and application Ser. No. 519,648, filed Oct. 31, 1974, now abandoned.

BACKGROUND OF THE INVENTION

The present invention relates to an improved apparatus and method for cutting deep slots in earth formations. More specifically, the present invention relates to an apparatus and method for cutting deep slots in earth formations to aid in the mining of mineral deposits, particularly coal. Still more specifically, the present invention relates to an apparatus and method for cutting deep, slightly-inclined slots beneath overburden, in aid of the movement of massive, substantially unbroken blocks of such overburden, particularly in the mining of shallow coal deposits.

In present day techniques for mining near surface deposits of coal and the like, the body of earth or overburden located on top of the mineral deposit is first removed. This removal of the overburden may be accomplished by various methods of excavation, but the basic operation consists of stripping the overburden to expose the mineral and depositing the stripped overburden in a mound in the area previously mined. The removal of the overburden, in strip mining operations, is generally performed by scraper-type earth-moving machines or bucket-type cranes. Thus, the major expense in strip mining is the excavation of large volumes of overburden materials.

In addition, special precautions must be taken with regard to toxic wastes, which, until the recent enforcement of stricter regulations, were often brought to the surface and dumped along with the overburden materials. Sulfuric acid, a product of sulfide weathering, and silt were then washed into the surface waters of the surrounding countryside.

It is therefore desirable to provide a mining technique for the removal of near surface mineral deposits which is less expensive than present day strip mining which can be carried out with a minimum of disturbance to the surface of the earth, and which minimizes the deposition of deleterious materials on or near the surface of the earth.

A mining technique which accomplishes these objectives is set forth in Applicant's U.S. Pat. No. 3,917,349. U.S. Pat. No. 3,917,349 describes a method for exposing sedimentary mineral deposits, such as coal, by shifting massive, substantially unbroken blocks of overburden on a Bingham plastic lubricant film, such as a clay-water paste. Each overburden block is prepared for movement by separating it from adjacent material along vertical faces by trenching and by pressure induced fractures. A basal plane of separation is formed above the mineral deposit by hydraulic fracturing along a bedding plane or by mechanically cutting a slot. The clay paste lubricant is injected into this basal plane of separation and also deposited on an earth fill ramp in front of the block. When the block is released by fracturing along its rear face, it slides onto the fill ramp covering the pit in the mined out area in front of the block and simultaneously opens a new pit to the rear of the block from which the mineral deposit can then be removed. The pit into which the block moves has been formed by the movement of a previous block, except for a starting excavation which provides the space for the movement of the first block of a series. Generally, the blocks will be impelled down slope by gravity. Each block movement is followed by removal of the mineral deposit from the bottom of the newly formed pit, the grading of a new ramp of fill in the bottom of the pit and the preparation of the next block for movement.

While separating the block of overburden along its base may be accomplished by hydraulic fracturing or undercutting, as disclosed in prior U.S. Pat. No. 3,917,349, undercutting is the preferred technique, since the inclination and flatness of the plane of separation can then be controlled. However, apparatus does not presently exist for mechanically cutting slots of the configuration necessary to efficiently practice the method of U.S. Pat. No. 3,917,349 (for example, 2 to 6 inches in thickness and about 100 feet deep from the exposed highwall to the rear of the block).

The object of the present invention is to provide such an undercutting apparatus. A further object is to provide an improved method for clay injection during the undercutting operation. A still further object of this invention is to provide an improved overburden block lubrication system for carrying out the mining method of U.S. Pat. No. 3,917,349. More specific objects of the present invention are to provide a simple powerful control system for guiding the cutting direction of the undercutting tool, to provide an efficient system for injecting high gel strength clay paste into the slot at the optimum entry point, to provide a sealing system which minimizes the unsupported portion of the slot, to provide a means for establishing an improved system for lubricating the block of overburden, which minimizes the strains to which the overburden is subjected, and to provide a system which will lubricate the block of overburden, despite the absence of substantial strength and rigidity in the block itself. A further object of the present invention is to provide a means for mining thin seams of coal.

In accordance with the present invention, a deep slot, having a large depth to thickness ratio is cut in an earth formation by a cutting assembly extending lengthwise to the full depth of the slot with its forward portion along the edge of the slot being cut. The cutting assembly includes a support extending to the full depth of the slot; a cutter bar extending along the forward portion of the support; a passage incorporated in the support for transmitting a liquid along the support, discharging the liquid in the interior of the slot in an amount and under a pressure sufficient to resist the earth pressure tending to close the slot, providing a major portion of the force needed to move the cutting assembly forward, and providing a lubricant for a block of overburden whose base is formed by cutting the slot and whose movement may be the primary objective in cutting the slot; longitudinal seals extending along the length of the support adjacent the cutter bar, which contact the upper and lower slot surfaces, thus centralizing the support and preventing liquids from flowing forward into the newly cut portion of the slot occupied by the cutter bar; and fluid transfer means spaced along the length of the cutting assembly and adapted to adjust the volume of fluid in the clearances on either side of the support, thus controlling the cutting direction. In cases where the slot cutting operation is intended to enable the movement of a block of overburden, the first-mentioned liquid injected through the cutting assembly into the slot will be a high gel strength paste and, in order to improve the system for lubricating the block, a second liquid passage may be mounted in the support adjacent the trailing edge of the support and a low shear resistance liquid is transmitted through the second passage and discharged to the rear of the support and into the interface between the paste and the bottom surface of the slot. The lubrication system may be further improved by fixing a bevel cutting means to the upper surface of the cutter bar at the slot entrance, thus creating a slight upward bevel at what will be the leading edge of the block of overburden in its subsequent movement. The convergent film geometry, thus created near the leading edge of the block, cooperates with an extra-high gel strength paste placed on a ramp in front of the block to maintain a continuous lubricant film as the block moves down the ramp.

DESCRIPTION OF THE PREFERRED EMBODIMENTS

As previously indicated, a slot of the order of 2 to 6 inches in height is preferred in carrying out the method of U.S. Pat. No. 3,917,349. A wider slot would be detrimental to the conduct of the method of the copending application. Accordingly, the apparatus of the present invention is designed for and ideally suited for cutting such thin slots. Further, since the desired slot is thin, the subject apparatus is small in size, requires low power to operate and is economical to build and operate relative to apparatus that would be required for cutting substantially thicker slots. Another distinct advantage of the apparatus and method of the present invention is that the same paste used to advance the cutting assembly of the present invention is used to stabilize the resulting slot and provide a lubricant film for moving a block of overburden, in accordance with the method of copending application Ser. No. 461,301. While other materials might be used, this paste material will generally be a water base paste of native clay.

Figures 1, 25:
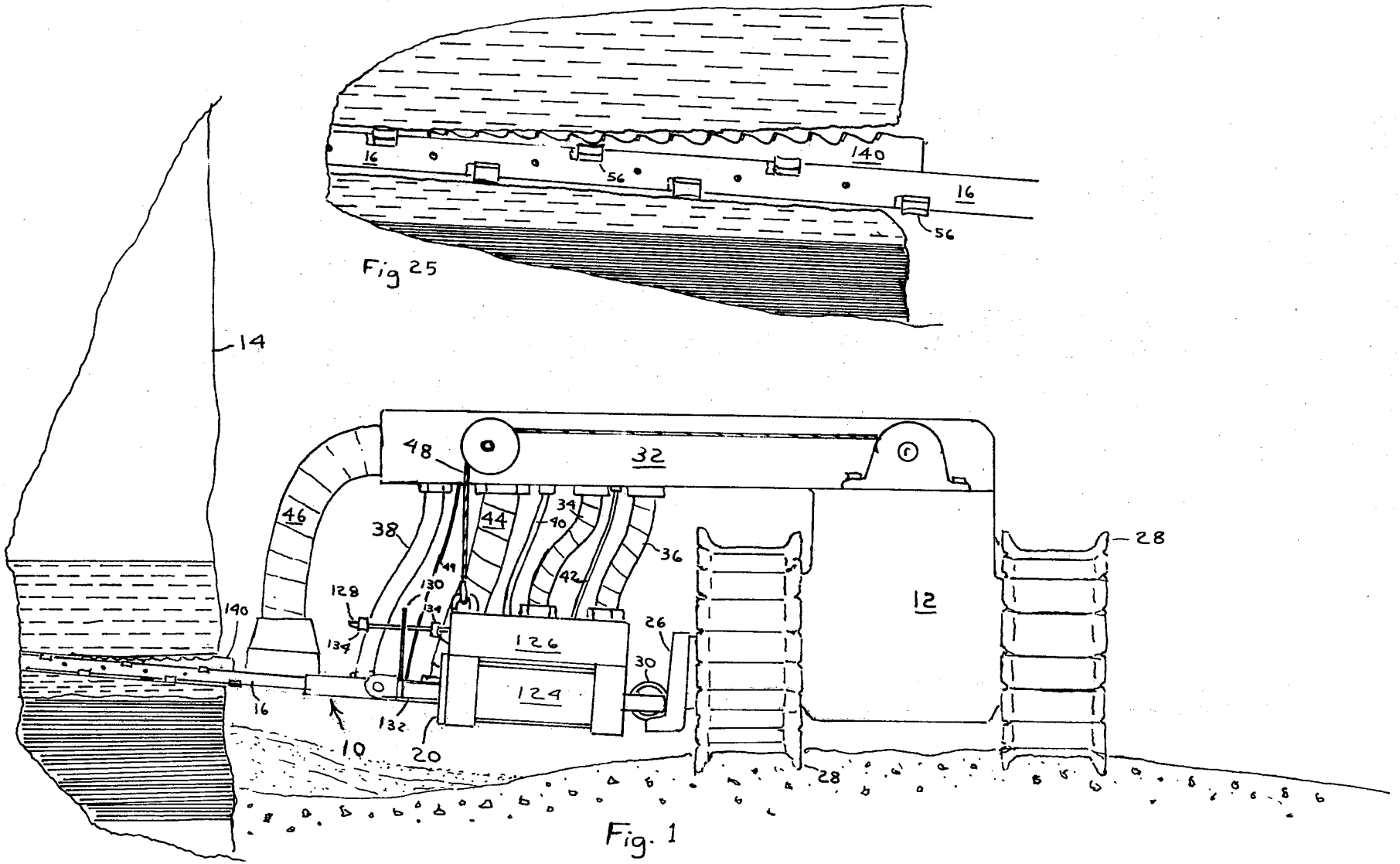
FIG. 1 is a front view of the power and control unit of the present invention, a forward edgewise view of the cutting assembly projecting into a slot and a sectional view of the overburden being undercut and the fill ramp supporting the trackmounted power control unit.
FIG. 25 shows a stepped cutter for beveling the leading edge of the block.
Figure 2:
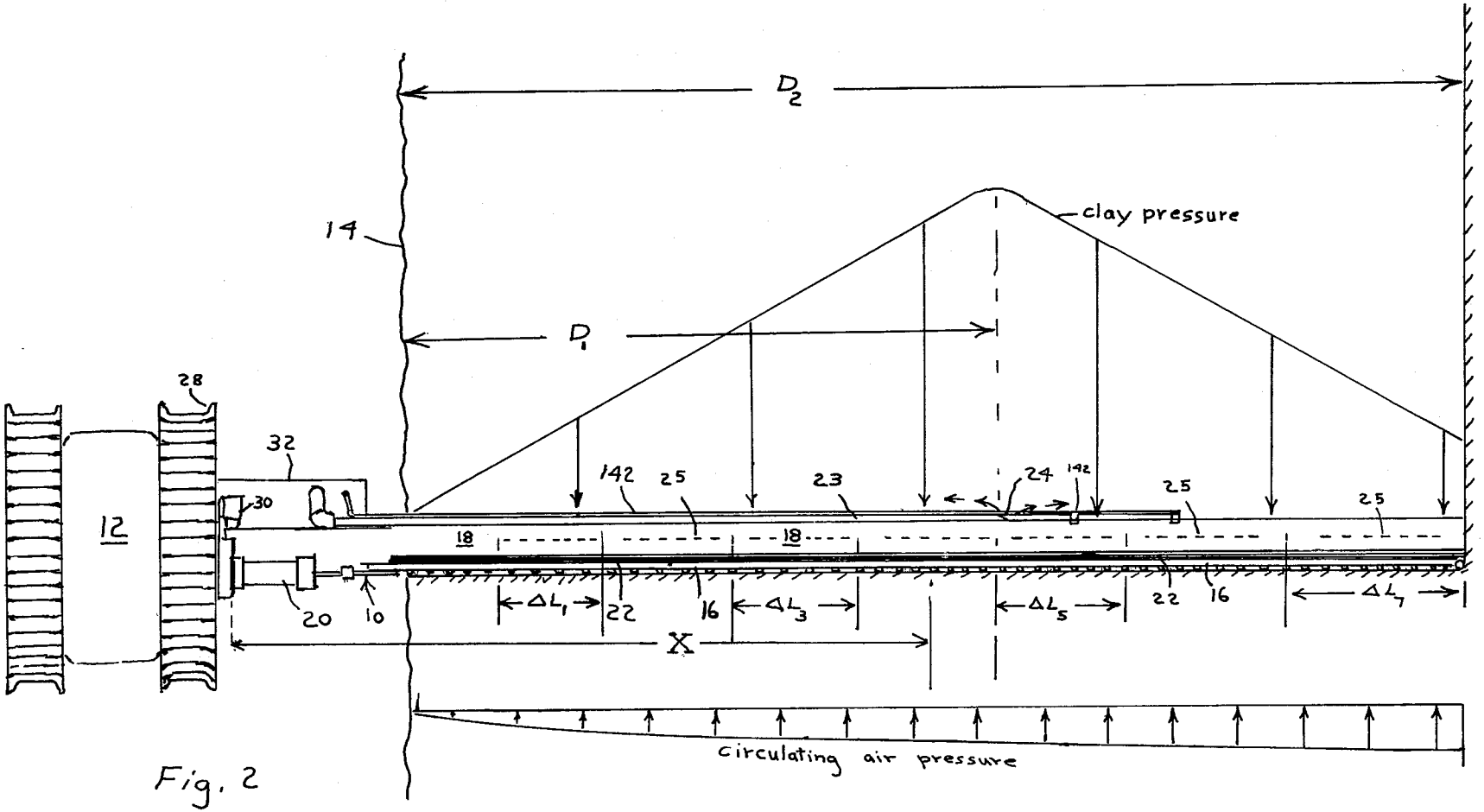
FIG. 2 is a bottom view of the track mounted power and control unit and cutting assembly projecting into a slot, with the section of the overburden taken parallel to the base of the slot.

The main components of the system for cutting a deep slot are shown in FIGS. 1 and 2 of the drawings. In FIG. 1, the cutting assembly 10 is shown projecting into a slot extending under the overburden. The track mounted power and control unit 12 is connected to the cutting assembly 10 and moves with it as the cutting assembly 10 is advanced along the base of the highwall 14 (toward the observer in FIG. 1).

Major components of the cutting assembly, as shown in FIG. 2, include cutter bar 16, guide assembly 18, reciprocating drive 20, seal 22, clay injection pipe 23, clay entry 24 and clearance pressure control ports 25. Ports 25 are indicated as a dashed line running the length of guide assembly 18. Not visible is a companion set of ports 25 on the opposite side of guide assembly 18. Seal 22 is also matched by a second seal 22 on the opposite side.

The track mounted power and control unit 12, shown in FIGS. 1 and 2, is assembled mainly from standard components which need not be described in detail. Crawler-tracked unit 12 includes a prime mover, an air compressor, a hydraulic pump, a drive system permitting low, precisely-controlled rates of crawl, a dust collecting system, clay mixing and pumping equipment, and an automatic control system, to be described later in detail. A backup plate 26, mounted on the side of unit 12, resists the recoil of the guide assembly 18 when cutter bar 16 is driven inward. Very large lateral thrusts must be resisted by unit 12 as it advances. For this purpose, the track pads are preferably equipped with ribs 28 running parallel to the direction of motion. Hydraulic ram 30 is mounted on backup plate 26 and serves to monitor the feed force component, $\Delta F$, transmitted to the end of the cutting assembly 10 by 12 as it advances. A manifold 32, cantilevered outwardly from the side of unit 12, provides conveniently located connections for various power and control functions required in the operation of cutting assembly 10. These connections include hydraulic power line 34, hydraulic return line 36, circulating air line 38, electric power cable 40, control cable 42, clay injection hose 44, dust collector hose 46, support cable 48, and gelled water line 49.

Air Passage

Figure 3:
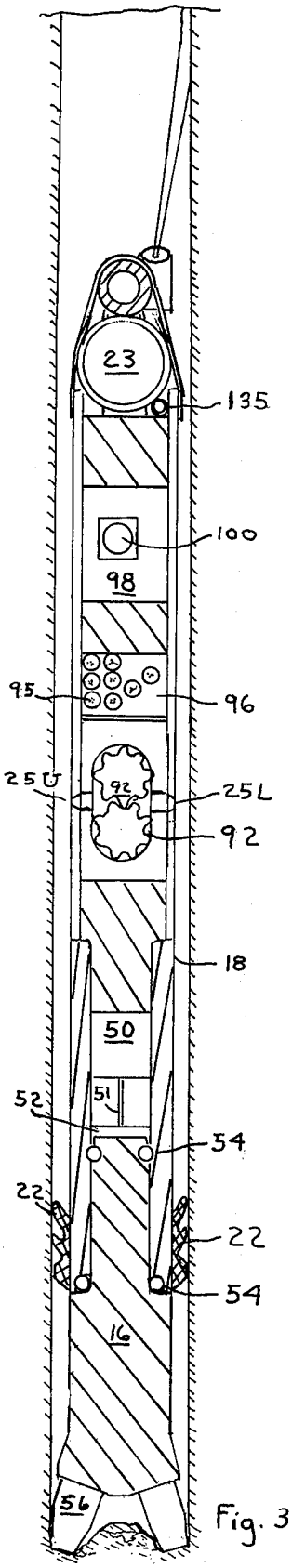
FIG. 3 is a cross sectional side view through the cutting assembly inside a slot.
Figure 4:
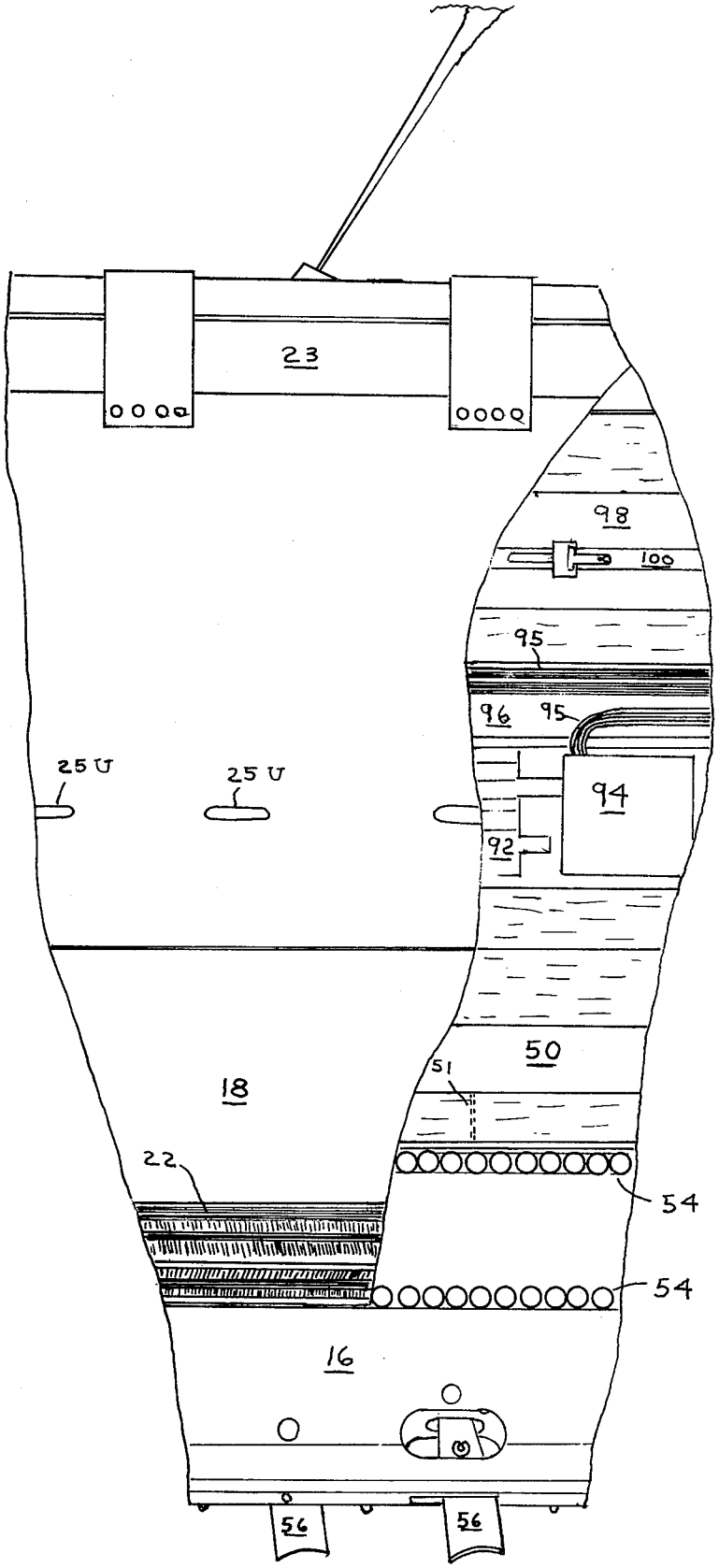
FIG. 4 is a bottom view of a short segment of the cutting assembly of FIG. 3, partially in section.

Referring to FIG. 3 (a cross section of the cutting assembly inside the slot) and FIG. 4 (a short segment of the cutting assembly partially cut away to show internal components), an air passage 50 runs the length of guide assembly 18. A major portion of the circulating air is transmitted the full length of assembly 18 and is discharged into the clearance space at the back end of the slot. The air then returns to the open end of the cut at high velocity through the clearance space around the cutter bar 16, flushing out the cuttings. A series of small passages 51 bleed a small portion of the circulating air from passage 50 and transmit it to bearing clearance 52. The linear bearings 54 are thus kept clean by a current of air flowing through the bearings to the outside.

Seal

Seals 22 (FIG. 3), mounted just behind the cutter bar on the upper and lower surfaces of the guide assembly, are significant components of the system of the present invention. Seals 22 exclude the clay paste pressure from the forward side of cutting assembly 10, so that the paste pressure generates the advancing force, F, applied to cutting assembly 10, and also serve to prevent clay paste from entering the region of cutter bar 16 and thereby interfering with the cleaning by air circulation. Seals 22 may be made of a rubber or synthetic plastic material with appropriately flexible edges. The seal will not always conform to irregularities in the cut surfaces and the gel strength and particle content of the clay paste will aid in sealing small openings which occasionally develop.

Clay Paste

What will be referred to throughout this discussion as clay paste may be of widely varying composition and might include a variety of industrial wastes such as phosphate slimes, an abundant waste product in the manufacture of phosphate fertilizer. In general, the clay paste should have sufficient colloid content to form a stable gel structure, the water phase being relatively immobile. The paste should form a low permeability filter cake. Generally, a native clay or shale from the overburden section will process into a suitable clay paste whose gel strength can be easily regulated by varying the water content. Typically, such material will contain a substantial fraction of silt size and larger particles in addition to clay particles. In some cases, leak-off control additives, such as CMC (carboxymethyl cellulose) used in oil field drilling muds, may be mixed with the clay to slow filtration into permeable boundaries.

Cutter Bar

Cutting assembly 10 is shown in transverse section in FIG. 3 and a short segment of cutting assembly 10 is shown in FIG. 4. The cutter bar 16 is slidably mounted in guide assembly 18 by means of linear bearings 54. Bearings 54 consist of balls running in grooves of circular section ground into the surfaces of bar 16 and guide 18. Bearings 54 permit the reciprocating motion of bar 16 while transmitting the feed forces, and resisting moments about the long axis of bar 16. Bearings 54 also serve to retain bar 16 in assembly with guide 18.

Figure 5:
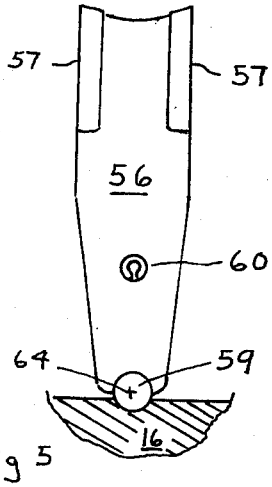
FIG. 5 is a profile view of a preferred drag-type cutter.
Figure 6:
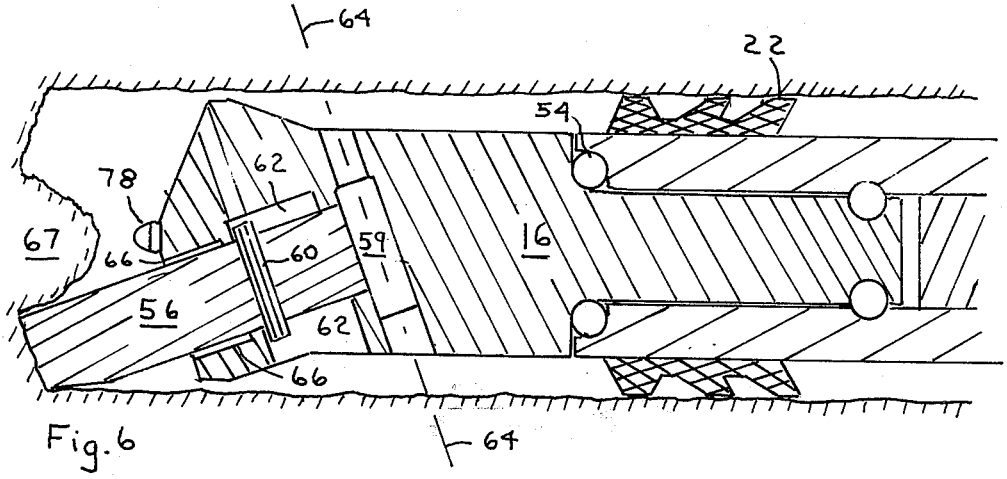
FIG. 6 is a sectional view showing a preferred cutter in assembly with the cutter bar.
Figure 7:
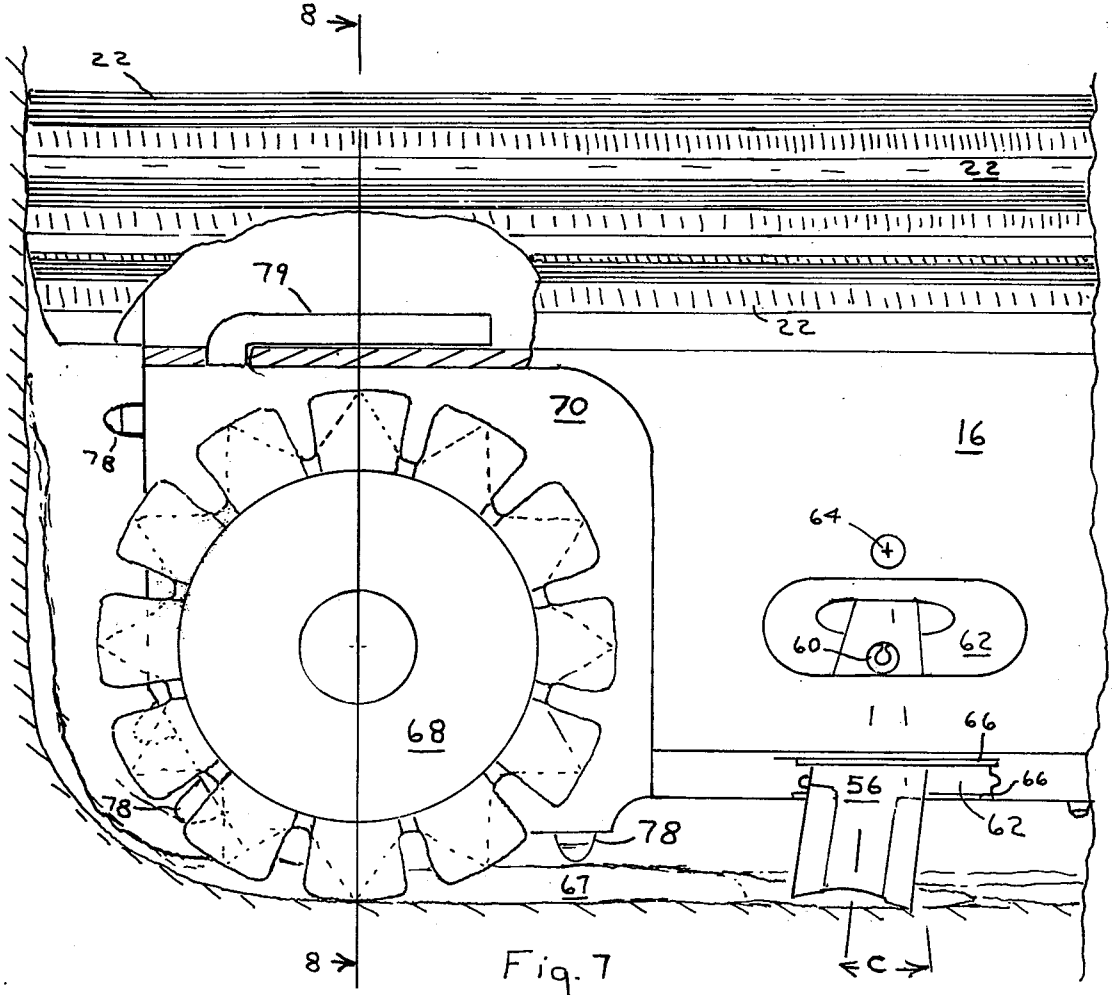
FIG. 7 shows one of two roller cutters mounted on the free end of the cutter bar.

A preferred cutter design, adapted to the reciprocating motion of cutter bar 16 is detailed in FIGS. 5, 6, and 7. The cutters 56 are alternately spaced on the sides of bar 16 along substantially the entire length of 16, as shown in FIGS. 3 and 4. FIG. 5 is a profile view of cutter 56. A pair of hard alloy teeth 57 are bonded to the working end of 56 facing in the opposite cutting directions. The other end of 56 is indented with a half round bearing groove which mates with hardened dowel pin 59. Above the groove and below teeth 57, cutter 56 is drilled through to accept a press fitted roll pin 60. FIG. 6 is a sectional view of bar 16 and cutter 56 in assembly, with the plane of the section taken perpendicular to the slot, while FIGS. 4 and 7 show profile views of cutter 56 in assembly with bar 16. As can be seen in FIGS. 6 and 7, cutter 56 is fitted to cavity 62 milled into bar 16. Cutter 56 is mounted so that it is free to rotate through a limited angle, *c*, about a fixed axis 64. Axis 64 is established by pin 59 press fitted to bar 16 and engaging the half round groove in cutter 56. At the leading edge of bar 16, cutter 56 is laterally supported by hardened strips 66 which provide wear resistant surfaces. Cutter 56 is retained in cavity 62 by roll pin 60 which projects into an undercut portion of cavity 62. Cavity 62 is shaped so as to provide bearing surfaces only where necessary to control the orientation of cutter 56 but providing generous clearance elsewhere so packed cuttings will not interfere with the rotation of cutter 56.

As cutter bar 16 reciprocates, each cutter 56 rocks to alternate positions away from the direction of motion, alternately placing each tooth 57 in appropriate cutting position when cutting bar 16 is driven forward and pulled out of the cut during reverse motion. Thus, cutter 56 cuts effectively in both directions, using one tooth at a time, with the unused tooth protected from wear and damage during its non-cutting stroke. The width of cutters 56 is preferably substantially less than half the width of the slot being cut so a substantial uncut rib of rock 67 is left in the center. Center rib 67 periodically grows up and breaks away. By leaving rib 67 uncut, the cutting rate per unit of power available is increased and lateral loads on the teeth can be balanced so that the net lateral load on each tooth is kept small.

When cutters 56 are replaced, bearing surfaces which undergo wear are also replaced by replacing pin 59 and wear plates 66.

Figure 8:
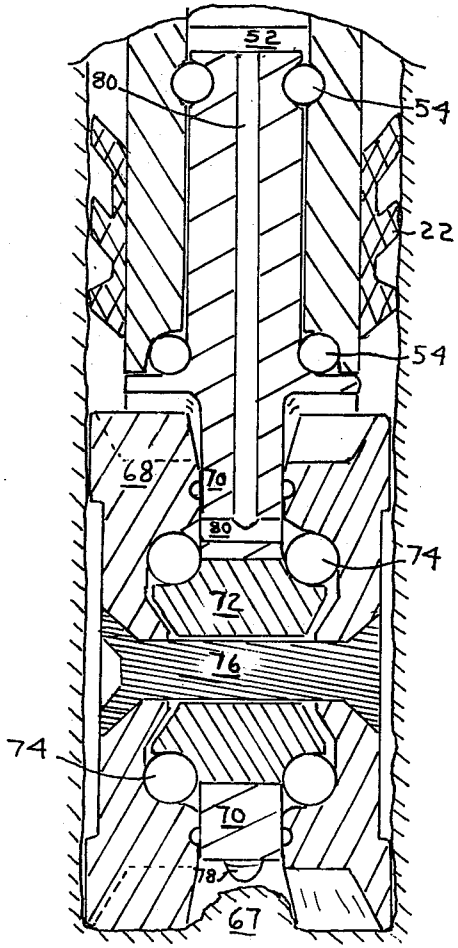
FIG. 8 is a sectional view of the roller cutters of FIG. 7 taken along the line 8—8.

Cutting in the corner of the slot at the free end of bar 16 is a special problem and a roller or disk type cutter is better suited to this task than a drag tooth. FIGS. 7 and 8 show an arrangement for a pair of roller cutters 68, working in the corner of the slot. The cutters 68 are mounted on opposite sides of a web 70 at the end of bar 16. A hub 72 is press fitted to web 70 and serves as a bearing support for cutters 68. Ball races are ground in both cutters 68 and hub 72 so that a compliment of ball bearings 74 facilitates the rotation and transmits the working loads of each of the cutters 68. The assembly of cutters 68, hub 72 and bearings 74 is maintained by rivet 76 which passes through the center of cutters 68 and hub 72.

A series of air passages 80 may be used to transmit circulating air to the bearing surfaces of cutters 68 to keep them clear of rock dust.

Like cutters 56, cutters 68 do not cut in the center of the slot so a rock rib 67 grows up between them. This rib is easily broken up by hard-metal buttons 78.

One hazard to the effective operation of a roller cutter is the generation of a gear pattern which meshes with the teeth. Cutting rate falls dramatically when the teeth start to track in such a pattern. In a tricone roller bit, tracking is prevented by altering the tooth spacing from one cone to the next. In the present application, tracking can be prevented in several ways. First, the 'T'-type milled tooth structure shown in FIGS. 7 and 8 has a low tracking tendency. Second, the cutters 56 are set to cut deeper than cutters 68 so that the cutting action of cutter 68 is interrupted each cycle. In this way, each time cutters 68 return to the cut, their orientation has been randomized.

The linear bearings 54, at the free end on bar 16, require that the ball races be plugged in some way. One method is by the use of a pin 79 fixed with respect to bar 16, as shown in a cut out view in FIG. 7. Another consideration regarding the linear bearing is the fact that the balls do not support the end of the race. For example, at the end of the inward stroke, the closest the balls can be to the end plugs 79 is one-half the full stroke length. This length of bar 16, which is unsupported by the ball bearings, might or might not be a problem depending on the rigidity of bar 16 relative to the peak cutting loads. There are, however, precautions that can be taken to provide lubrication for the end assembly, such as grease lubrication, air oiling and the fabrication of pins 79 from composites, such as sintered bronze impregnated with PTFE (polytetrafluoroethylene).

Clay Injection and Feed Force

Injection of clay paste into the slot as the slot is generated is an essential part of the slot cutting operation. The clay prevents spalling and resists earth pressure that would otherwise close the slot. As will be explained later in greater detail, the paste also serves as a medium for applying steering moments to guide assembly 18 in order to control cutting direction. The pressure of the clay acting against the cutting assembly 10 drives 10 forward, supplying nearly all the force required to feed the teeth into the cut. This powerful forward driving force, F, is supplemented by a relatively small force, ΔF, applied to the outer projecting end of cutting assembly 10 by unit 12 as it moves ahead just fast enough to keep 10 oriented perpendicular to the direction of advance.

The paste is, preferably, made from native clay or shale by clay mixing equipment mounted on unit 12. If the undercut material is suitable, cuttings from the undercutting operation would be used to manufacture the paste. The paste is pumped through clay injection hose 48 into tubular passage 23 which lies along the trailing edge of 18. The diameter of passage 23 is restricted by the need to provide ample clearance inside the slot. For example, if the slot is 4 inches thick, the ID of passage 23 might be about 2½ inches or 0.2 ft. As a consequence, the pressure drop in passage 23 would be quite large under normal flow mechanisms. The Bingham equation for flow rate of plastic in a tube is:

$$Q = \frac{nd^4}{128ln}\left[P - \frac{4}{3}P_o + \frac{P_o^4}{3P^3}\right] \quad (1)$$

where $P_o = 4Tl/d$ and $P_o$ is the threshold flow pressure, $P$ is the pressure drop across the tube, $l$ is the length of the tube, $d$ is the passage diameter and $\eta$ is the absolute viscosity.

For example, the clay paste injected into the slot might have the following properties:

Gel strength, T = 50 lb/ft²,

Viscosity, $\eta$ = 0.3 lb. sec./ft² or about 143 poise and

Solids Content 50% by volume.

Let $d$ = 0.2 ft.

$l$ = 50 ft.

and Q = 0.2 ft³/sec.

This value of Q is near the maximum injection rate expected. Then, from equation (1), $$P = 1.5 \times 10^5 \text{ lb./ft.}^2 \text{ or } 1{,}042 \text{ psi.}$$

To this pressure is added the pressure at the point of injection inside the slot and the pressure drop in line 48, to obtain the required pump pressure, which is then in the neighborhood of 1200 psi.

Figure 9:
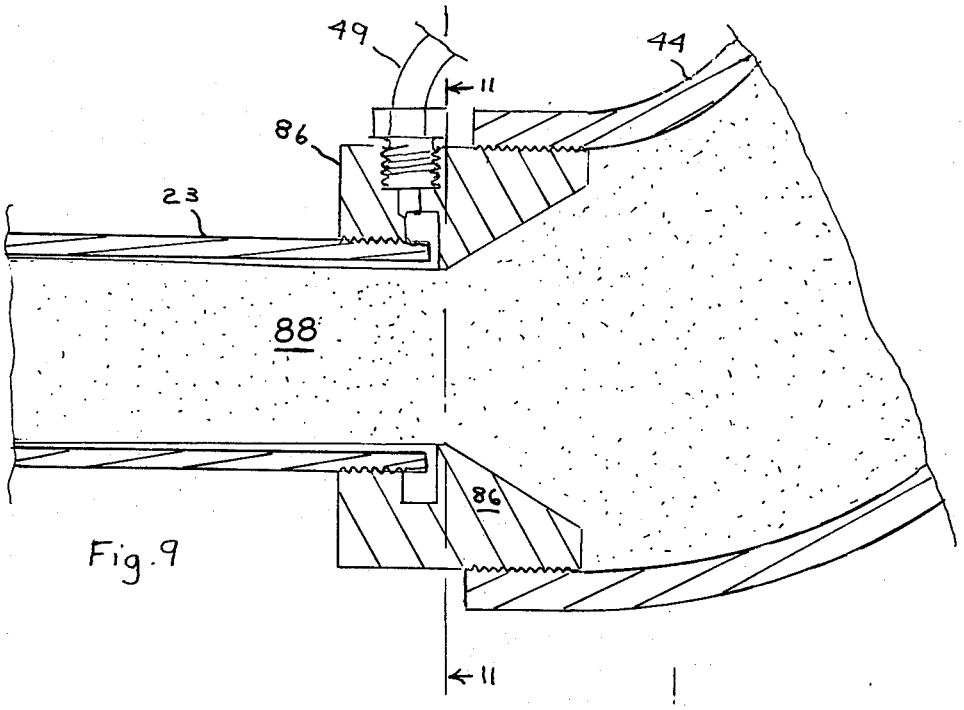
FIG. 9 is a sectional view of an extrusion nozzle used to reduce the flow resistance of the clay paste by introducing a boundary lubricant.

The excessive pressure drop in passage 23 can be substantially eliminated by means of a device shown in FIG. 9. FIG. 9 is a sectional view through an extrusion nozzle 86 joined to the inlet of passage 23 and joined through an elbow to the discharge end of clay injection hose 44 (FIG. 1). The clay extrudes from the throat of the nozzle in the form of a cylinder 88 whose diameter is smaller than the ID of 23. The annular clearance between cylinder 88 and the ID of passage 23 is filled with water, or preferably a gelled water composition, injected from gelled water line 49. Water gel enters the annulus through a passage formed by the clearance between the end of passage 23 and the throat of nozzle 86. The injection rate of water gel is a small fraction of the clay paste flow rate. The initial annular clearance is set by the difference between the IDs of passage 23 and cylinder 86. However, as the clay cylinder moves a short distance down passage 23, it adjusts its diameter so that the thickness, $t$, of the water gel film is given by:

$$t = \tfrac{1}{2}(Q_1/Q_2)\, d \qquad (2)$$

where $Q_1$ is the water gel flow rate,
$Q_2$ is the clay paste flow rate and
$d$ is the ID of passage 23.

Flow friction for the clay plug with a low viscosity boundary film is given by:

$$Q_2 = (nd^3t/16l\eta')\,[P - P_o] \qquad (3)$$

where $t$ is the film thickness, ft.,
$\eta'$ is the film viscosity, lb. sec./ft$^2$,
$T'$ is the film gel strength lb./ft$^2$,
$l$ is the flow path length, ft,
$d$ is the flow diameter, ft. and
$P_o = 4T'l/d$ is the threshold flow pressure.

For a numeric example, let
$d = 0.2$ ft. and
$Q_1/Q_2 = 0.01$

Then, from equation (2), $t = 0.001$ ft
and let $Q_2 = 0.2$ ft$^3$/sec.,
$l = 50$ ft.,
$\eta' = 4 \times 10^{-4}$ lb. sec/ft.$^2$, and
$T' = 2$ lb/ft.$^2$ Then $P_o = 2000$ lb/ft.$^2$ or 13.8 psi and, from equation (3),
$P = 4546.$ lb/ft$^2$ or 31.6 psi.

Figure 10:
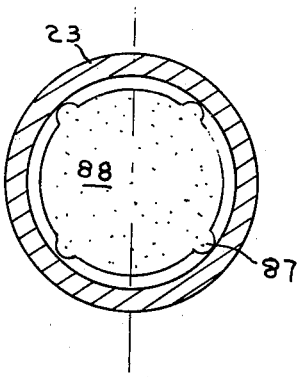
FIG. 10 is a cross section through the paste injection tube down stream from the nozzle of FIG. 9.
Figure 11:
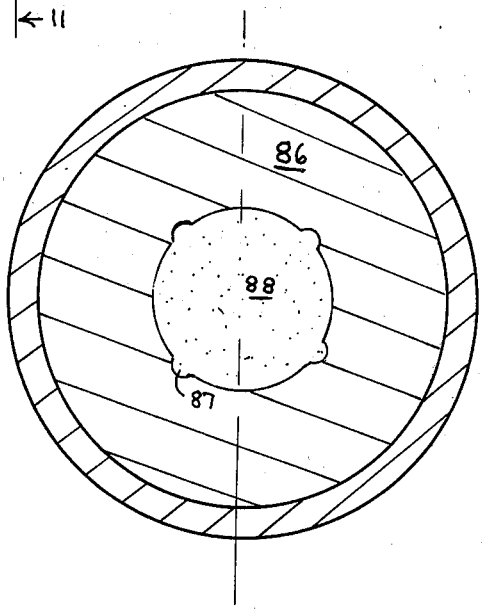
FIG. 11 is a cross section through the extrusion nozzle of FIG. 9 along line 11—11.

FIGS. 10 and 11 illustrate an optional feature in the nozzle 86, to aid the establishment of a symmetrical lubricating boundary film. FIG. 11 is a section through the throat of the nozzle 86. Notches in the nozzle result in an extruded clay cylinder 88 with projecting flutes 87. As the clay cylinder 88 enters passage 23, the flutes 87 centralize the cylinder, helping to establish a more uniform water gel layer around the clay paste cylinder 88.

After passing through passage 23, the clay exits from clay entry 24 (FIG. 2), located past the mid-depth in the slot being cut. The flow of clay paste in the slot divides roughly in half with one flow stream moving parallel to guide assembly 18 toward the deep end of the slot and the other flow stream moving along 18 toward the open end of the slot. The pressure declines in both flow directions from clay entry 24, resulting in a distribution of clay pressure along guide assembly 18 as indicated in FIG. 2. The driving force resulting from this pressure distribution is given by:

$$F_p = -[2D_1^2 - 4\,D_1D_2 + D_2^2]T \qquad (4)$$

where $D_2$ is the depth of the slot, $D_1$ is the depth of the clay entry point 24 of the clay paste and $T$ is the gel strength of the paste. $D_1$ will be greater than $\tfrac{1}{2}D_2$, so that the resultant driving force, $F_p$, is deeper than the mid-depth position.

The pressure distribution of the air circulating in the clearance around cutter bar 16 is also represented in FIG. 2. This results in a large force tending to retard the cutting assembly. If $\bar{P}_a$ is the mean circulating air pressure along bar 16, then the force of the air on the cutting assembly $F_a$ is given by:

$$F_a = -D_2\, h\, \bar{P}_a \qquad (5)$$

where $h$ is the slot thickness.

A relatively small additional driving force component, $\Delta F$, is transmitted to the projecting end of the cutting assembly by unit 12 as 12 advances just fast enough to hold the cutting assembly perpendicular to the cutting direction. $\Delta F$ is given by:

$$\Delta F = \frac{[(2D_1^3 - D_2^3D_2) - (2D_1 - D_2)^2(\frac{D_2}{6} + \frac{2D_1}{3})]T + KD_2F_a}{X} \qquad (6)$$

where X is the distance from the projecting end of cutting assembly 10 to mid depth in the slot being cut and $K$ is a constant whose value depends on the shape of the air pressure distribution. K is likely to equal about 0.1 as we will assume in the following example.

Let $D_1 = 50$ ft., $D_2 = 80$ Ft., $T = 50$ lb/ft$^2$,
$X = 52$ ft., $\bar{P} = 25$ psi or 3600 lb/ft$^2$,
$h = \tfrac{1}{3}$ ft. and $K = 0.1$.

The net feed force, $F_f$, on the cutting assembly is given by:

$$F_f = F_p + F_a + \Delta F \qquad (7)$$

From equation (4),
$F_p = 230{,}000$ lb.,
from equation (5),
$F_a = -96{,}000$ lb.,
and, from equation (6),
$\Delta F = 15{,}000$ lb.
Then, from equation (7);
$F_f = 149{,}000$ lb.

The feed force can be adjusted by altering the gel strength of the paste, T, the air circulation rate, or the clay injection rate.

Control of Cutting Direction

The cutting assembly 10 is thin compared with its length and consequently is not rigid enough to be guided by moments applied to its outer projecting end which is mounted on unit 12. Steering must be applied at several locations along the length of the cutting assembly 10 to control the flatness and orientation of the slot. In the present invention, powerful steering moments are independently controlled at several locations along the length of guide assembly 18, by selectively injecting clay paste into the clearance above or below 18, as appropriate.

Figure 14:
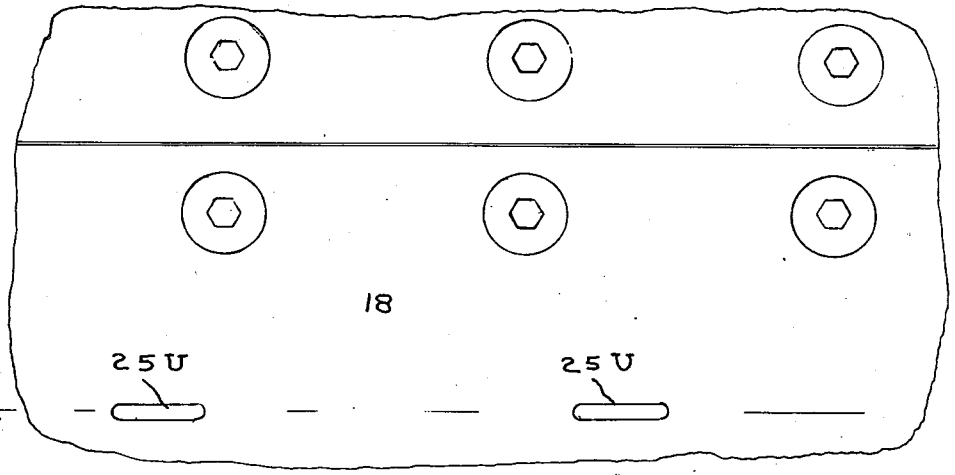
FIG. 14 is a top view of a portion of the guide assembly, showing slots through which paste is injected and withdrawn from the clearance.
Figure 13:
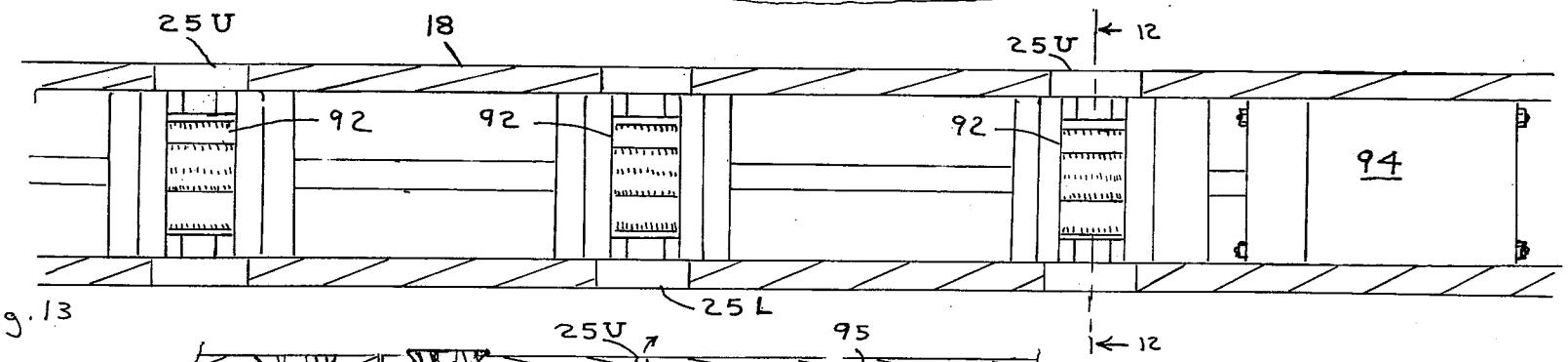
FIG. 13 is a longitudinal section through the guide assembly showing control pumps connected in series.
Figure 12:
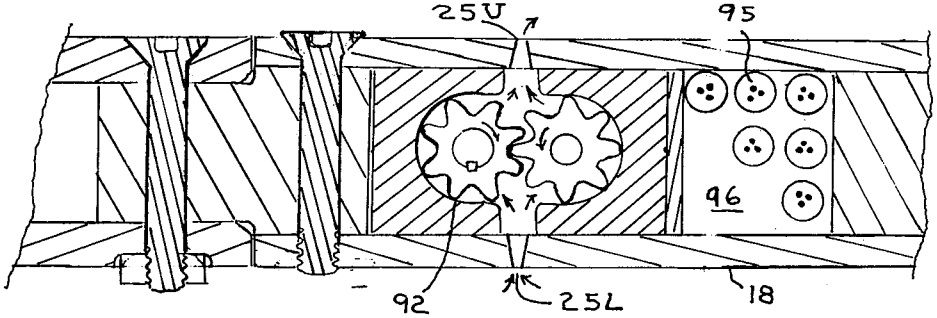
FIG. 12 is a transverse section through the guide assembly showing the pump used to modify clearance pressure in order to control cutting direction.

Control pumps 92 are shown in FIGS. 3, 4, 12 and 13. Pumps 92 are electrically driven by reversible gearmotors 94. Pumps 92 are preferably of the gear or lobe type. Power is transmitted to motors 94 by power cables 95, which follow passage 96 from unit 12. The pumps 92 are connected to openings 25U and 25L in the upper and lower surfaces, respectively, of guide assembly 18. Pumps 92 are thus connected so that clay paste can be transferred in either direction from one clearance, between the guide assembly 18 and the slot being cut, to the other. Pumping alters the local pressure distribution in the clearances, resulting in steering moments for controlling the cutting direction. Independently controlled steering moments are thus created on individual segments, $\Delta$ L, of guide assembly 18. In FIG. 2, the cutting assembly is divided into segments $\Delta L_1$, through $\Delta L_7$. Each $\Delta L$ is associated with a set of orifices 25, and a set of pumps 92 controlled as a unit. In FIG. 13, a preferred arrangement of pumps 92 is shown. The pumps 92 are spaced along guide assembly 18, each connected to a pair of orifices 25 and all driven by a single motor 94. Then each segment ΔL would contain a string of pumps driven by a single motor 94, tied to a separate control circuit. The preferred shape of the openings 25 can be seen in FIGS. 12, 13 and 14 and is a narrow slot widening toward the interior. Particles above a certain size are thus prevented from entering the pump while orifices 25 will resist being clogged by larger particles because the openings are elongate.

Figure 15:
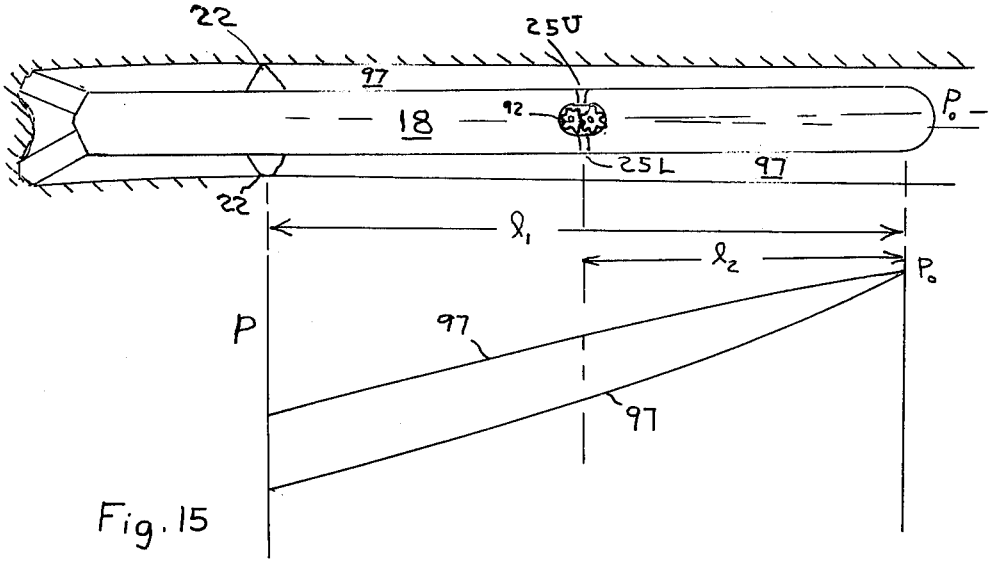
FIG. 15 shows the modification of paste pressure in the clearance above and below the guide assembly due to relative motion between the guide assembly and the faces of the slot.

FIG. 15 illustrates the distribution of pressure in the upper and lower clearances 97U and 97L, respectively, for the case where guide assembly 18 is moving ahead in the slot but pumps 92 are not in operation. The pressure in the two clearances declines from $P_o$ at the trailing edge to minima at seals 22. The gradients in pressure are created by shearing of the paste, due to the relative motion between guide assembly 18 and the walls of the slot being cut. The pressure gradients plotted in FIG. 15 are labeled 97U and 97L (the clearances to which they apply). If guide assembly 18 were centered in the slot, the pressure distribution around guide assembly 18 would be balanced and curves for clearances 97U and 97L would coincide. But, since guide assembly 18 is angularly displaced above the centerline of the slot, shearing of the paste produces a greater reduction in pressure in the upper, narrower, clearance. The resulting pressure difference would tend to increase the deviation of guide assembly 18.

Figure 16:
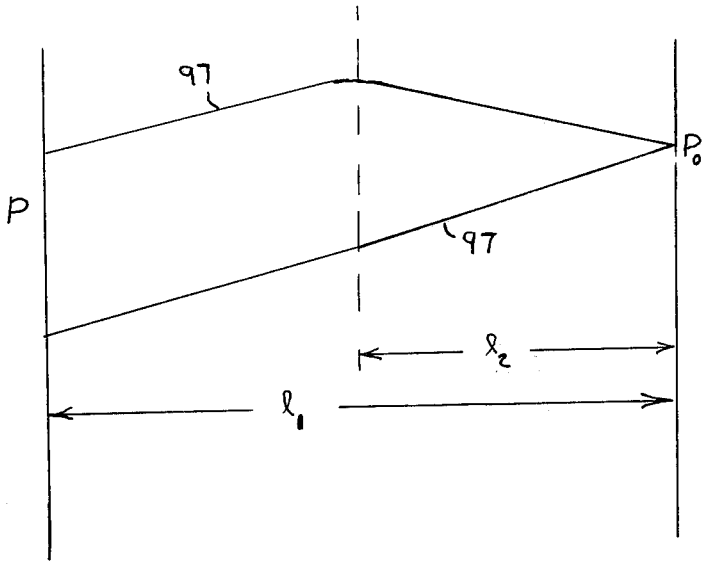
FIG. 16 shows the modification of paste pressure in the upper and lower clearances when the control pump is operating.

FIG. 16 shows the pressure distribution around guide assembly 18 when pump 92 is withdrawing paste from clearance 97L and discharging into clearance 97U. The resulting control moment, M, tends to rotate guide assembly 18 clockwise around seals 22. The magnitude of the moment will vary with the pump rate and the rate at which guide assembly 18 changes direction. The available control moment is very large. As an example, we will calculate the magnitude of the control moment for the following special case. Let openings 25 be midway between seals 22 and the widening of clearances 97. (In FIG. 15 $L_2/L_1 = \frac{1}{2}$). Let guide assembly 18 be centered in the slot. Assume that guide assembly 18 resists moment M without rotation. Let the pump rate, $q$, for pumps 92 in segment, ΔL, be given by:

$$q = V h_1 \Delta L \tag{8}$$

where $V$ is the rate of advance of guide assembly 18 and $h_1$ is the width of clearances 97. Then, the control moment, M, is given approximately by:

$$M = \frac{7}{12}\left[\frac{T l_1^3 L}{h_1}\right] \tag{9}$$

Let $\Delta L = 10$ ft.,
$V = 0.008$ ft./sec. or 28.8 ft./hr.,
$h_1 = 0.045$ ft.,
$L_1 = 2$ ft. and
$T = 50$ lb./ft.$^2$ Then, from equation (8),
$q = 0.0036$ ft.$^3$/sec. or 1.6 gal./min. and, from equation (9),
$M = 51{,}850$ ft.-lb.

Thus, the available control moment is much larger than would be necessary to guide the cut, and the flow rates required to generate the control moments are small.

Straightness Sensors

Oil filled passage 98 runs the length of the guide assembly 18. (See FIG. 3). Straightness sensing element 100 is stretched through the center of passage 98 and anchored under substantial tension at both ends of the passage. The average density of sensing element 100 is matched to that of the oil so that element 100 has neutral buoyancy. Since sensing element 100 is under tension and matches the density of the oil filling passage 98, it has no tendency to sag between its end connections. Therefore, its tendency is to follow a straight line.

Figure 17:
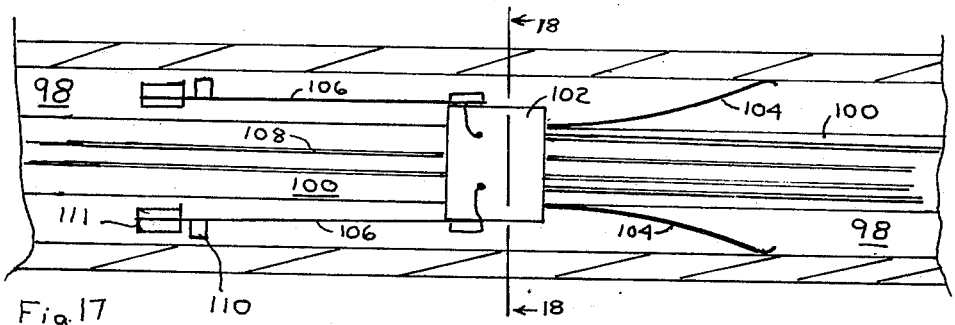
FIG. 17 is a longitudinal section through the guide assembly showing the mounting block on a tubular straightness sensing element.
Figure 18:
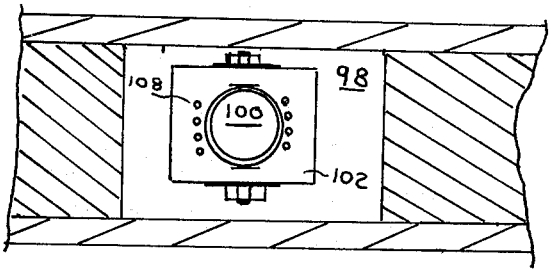
FIG. 18 is a sectional view of the guide assembly of FIG. 17 taken along the line 18—18.

In accordance with FIGS. 17 and 18, spaced along the length of sensing element 100 are slender centralizing spring elements 104, which tend to center element 100 between the top and bottom walls of passage 98. If passage 98 becomes curved in a vertical plane because of deviation of the slot, sensing element 100 will be pulled toward the inside of the curve deflecting the spring 104 on that side.

A simple switching arrangement, shown in FIGS. 17 and 18, turns the relative movements between passage 98 and element 100 into control signals.

FIG. 17 is a longitudinal section of passage 98 showing a short segment of sensing element 100. FIG. 18 is a transverse section, through passage 98 and sensing element 100, showing mounting block 102 sleeved on the outside of element 100. Sensing element 100 is preferably a sealed aluminum tube, air filled in order to match the oil density in passage 98. Blocks 102 are made of a low density insulating material, again, to match the density of the assembly to the oil in passage 98. Blocks 102 support centralizer spring elements 104, contact springs 106 and lead wires 108. The contact assemblies consist of leaf springs 106, mounting contacts 110 and permanent magnets 111 near the free ends. The other end is rigidly attached to block 102. The contacts 110 project slightly beyond the magnets 111.

The purpose of the magnets is to reduce arcing when the contact is made and broken. Arcing would cause erosion of the contact surfaces and decomposition of the oil in passage 92, with attendant production of carbon. If contacts 110 were rigidly mounted on block 102, contact would be made and broken very slowly, contact pressure would be vanishingly low much of the time, and this last condition, attended by vibration, would result in "dancing" of the contact. All of these factors will tend to produce arcing. By mounting contact 110 on the end of springs 106, together with magnets 111, the switch has a snap shut, snap open characteristic. Another precaution against arcing is to limit the control circuit to low power levels, less than 15 volts and 2 amps, for example.

Figure 20:
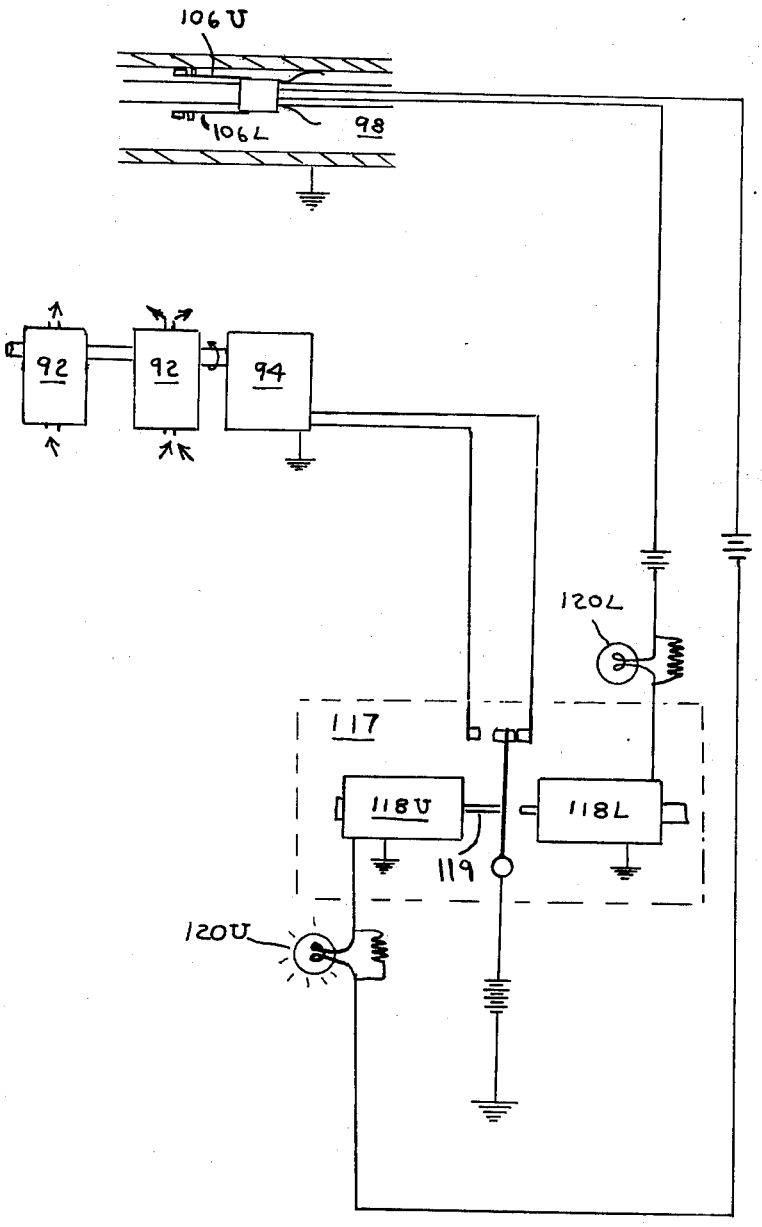
FIG. 20 is a schematic of the control circuit.

A pair of wire leads 108 are connected to each pair of contacts 111. The other side of each circuit is completed by ground connections to cutting assembly 10. The contact wires are connected to manifold 38 by feed throughs to cable 46 (FIGS. 1 and 2). A diagram of the control circuit is shown in FIG. 20.

Sensing element 100 may be thought of as a cord stretched through a straight narrow passage. When the passage becomes curved, the cord presses against the wall of the passage toward the inside of the curve. Let
ΔL equal the spacing of blocks 102,
$F_x$ equal the tension in 100,
$F_z$ equal the force of contact between 104 and the wall of passage 98 and
R equal the radius of curvature.

The relationship between these variables is then:

$$R = F_x \Delta L / F_z \quad (10)$$

Straightness sensor 100 can be adjusted to detect a very small curvature of guide assembly 18 in a vertical plane if the curvature persists over a substantial length. The radius of curvature required to make a contact actuating a control circuit is given by equation (10).

Let $\Delta L = 10$ ft., $F_x = 1000$ lb. and $F_z = 1$ lb., where $F$ is the force on 104 required to close the switch. Then, from equation (5), $R = 10{,}000$ ft.

In other words, if the radius of curvature of guide assembly 18 falls below 10,000 ft., a control circuit is actuated.

Inclination Sensors

Figure 19:
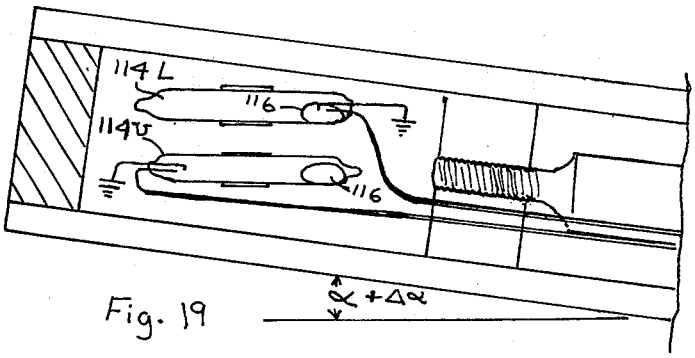
FIG. 19 is a longitudinal section through the end of the guide assembly showing mercury switches for monitoring inclination, and the termination of the tubular straightness sensor.

All steering pumps 92 are controlled by straightness sensor 100 except for the group within segment $\Delta L_7$ (see FIG. 2) at the deep end of guide assembly 18. The pumps 92 within $\Delta L_7$ serve to control the inclination of the slot. FIG. 19 is a longitudinal section through the end of guide assembly 18 showing mercury switches 114 U and 114 L which serve to detect departures from the desired slot angle $\alpha$. Switches 114 L and 114 U are mounted at an angle to the long axis of guide assembly 18 so that their neutral axes are approximately horizontal when assembly 18 is inclined at an angle $\alpha$. If the inclination of assembly 18 increases above $\alpha+\Delta\alpha$, where $\Delta\alpha$ is a small angle, the mercury pool 116 moves to the contact end of switch 114 L signalling the control circuit that the angle is too high. Conversely, if the inclination of assembly 18 falls below $\alpha-\Delta\alpha$, the mercury pool 116 moves to the contact end of switch 114 U signalling that the inclination is too low. A significant correction at the end of cutting assembly 10 will be followed by a response from the other control circuits to bring the other parts of assembly 10 back into line.

Switches 114 should have a small differential angle, that is the angle between the make and break positions. They should also be as resistant as possible to shock and vibration. Shocks may cause the mercury pool to bounce and give false signals. Bounce can be minimized by using mercury wetted contacts and having an extra long tube for travel of pool 116 before contact. A damped mercury switch may also be used.

Control Circuit

In FIGS. 17, 18 and 19, each control switch 106U, 106L, 114U, and 114L is connected to a control circuit capable of switching motors 94 off or on, in forward or reverse. A simple control circuit is shown in FIG. 20. It consists of a power switch 117 operated by two solenoids 118U and 118L. The solenoids are actuated by control switches 106U and 106L.

Operation of the control circuit is as follows. If the slot is perfectly straight, then passage 98 is straight and sensing element 100 is centered inside 98. Solenoids 118 are inactive and the power circuit is open. Now assume that the center of the slot undergoes a gradual downward drift as it is extended so that guide assembly 18 acquires a downward curvature. As the radius of curvature becomes smaller, a point is finally reached when contact spring 106U makes contact, activating solenoid 118U. Push rod 119 is then extended, completing the power circuit to motor 94 which then drives pumps 92 so that paste is transferred from the lower to upper clearance. The control moment then redirects the advancing cut upward. The downward drift is reversed and the curvature of guide assembly 18 diminishes until contact at 106 U is broken. If the curvature of guide assembly 18 becomes reversed, switch 106L would be closed and solenoid 118L activated, completing the reverse power circuit to transfer paste in the reverse direction. Each control circuit is connected to a panel of lights, 120U or 120L, to show which control circuits are active and the pumping direction.

Reciprocating Drive

The reciprocating hydraulic drive is not a novel part of the present invention and will be described only briefly. The reciprocating drive may consist of a double acting hydraulic cylinder 124 (FIG. 1) with a high conductivity pilot-operated valve 126. A small spool-type pilot valve, not shown in the FIG. 1, operates the main valve 126. The pilot valve in turn is operated by push-pull rod 128. Arm 130, extending at right angles to connecting rod 132, reverses the pilot valve at the end of each stroke when it contacts stops 134 on rod 128.

Control Panel

Figure 21:
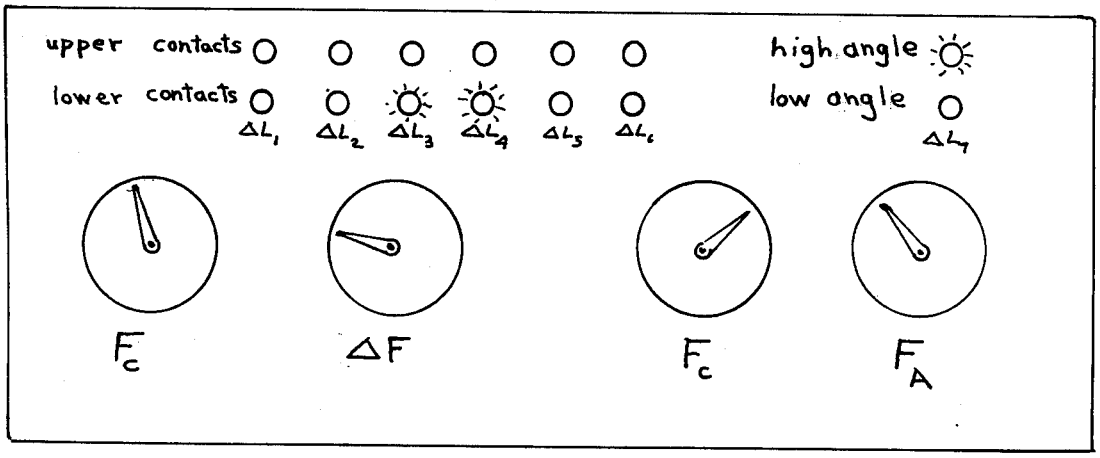
FIG. 21 shows a panel display which may be used to show the state of the control circuits and the magnitudes of the forces acting on the cutting assembly.

A control panel is represented in FIG. 21. The status of each control circuit is displayed on the panel by pairs of lights 120U and 120L. Each pair of lights is labelled, $\Delta L_1$, $\Delta L_2$, . . . $\Delta L_7$, according to the segment of guide assembly 18 controlled by that particular circuit. If none of the lights were lit, this would indicate that the slot is being cut straight and at the proper angle within the limits of the sensitivity of the straightness and inclination sensors. In FIG. 21, lower contact lights $\Delta L_3$ and $\Delta L_4$ are lit. This indicates that the cut has deviated upward at mid depth and the appropriate control pumps have been activated to redirect the cut downward. The high angle $\Delta L_7$ light is also shown in the figure as lit. This indicates that the cut has deviated above the preselected angle, $\alpha$, and the control pumps in $\Delta L_7$, are transferring paste into the lower clearance to redirect the cut downward at the deep end of the cutting assembly 10.

One problem likely to arise with the control system, as it has been described, is a tendency to overcorrect and oscillate. In a correction sequence, the correction angle could continue to build up until contact is broken and the deviation would continue past center until the other control circuit is activated to reverse the new deviation. One approach to minimizing such oscillation would be an elaboration of the power control switch which would reverse the operation of pumps 92 for a brief time interval at the end of each control maneuver. By observing the panel lights, it would then be possible to manually adjust the time intervals for reverse control pump operation so as to minimize the frequency of control maneuvers.

The control panel shown in FIG. 21 displays four gages. One gage labeled $F_c$ is connected to the high pressure side of the reciprocating drive 20 and can be graduated to read the cutting force, that is the force needed to drive the cutter bar back and forth. The gage labeled $\Delta F$ is connected to hydraulic ram 30 and is graduated to read the force applied to the projecting or mounted end of cutting assembly 10 by unit 12. Gage $F_p$ is connected to small water-filled tubular passage 135 (FIG. 3) which opens into the slot being cut at the same depth in the slot as clay entry 24, the point of paste injection. $F_p$ monitors the clay injection pressure at its point of entry into the slot being cut. Gage $F_p$ is calibrated to read the driving force due to the paste pressure on the cutting assembly. $F_A$ monitors the circulating air pressure and is calibrated to give the retarding force of circulating air on the cutting assembly. The net feed force is then:

$$F_f = \Delta P + F_p - F_a$$

which is equation (7) already discussed.

One use for the control panel information is to assess tooth condition. When the teeth are sharp, $F_c/F_f \approx 1$. As the teeth become dull, this ratio will decline approaching, perhaps, $F_c/F_f \approx 0.5$.

Cutting Rate and Power Requirement

The cutting rate is proportional to the power that can be delivered to the teeth on the cutter bar 16. Let V be the velocity of the cutter bar and $F_c$ equal the total cutting force on the teeth. The power available for rock removal is then:

$$P_w = VF_c \tag{11}$$

For a sharp drag tooth, with adequate relief angle, the cutting force will be roughly the same magnitude as the feed force. As already pointed out, the cutting force $F_c$ can be read directly on the control panel. $F_c$ is directly proportional to the feed force and both the cutting and feed forces can be controlled to some degree by modifying the paste injection rate, clay paste properties, and air circulation rate.

If the feed force is about equal to the cutting force, then the earlier example demonstrates that a cutting force of 150,000 lb. is an easily attained operating level.

In the following expression, $$P_w = KQ_r\sigma, \tag{12}$$

$P_w$ is the power input ft-lb/sec., $Q_r$ is the rock removal rate, ft³/sec., $\sigma$ is the rock compressive strength lb/ft² and $K$ is an empirical factor which takes the cutting mechanism, and such things as rock friability or toughness into account.

Published data, from experiments measuring drilling energy per unit of rock removal, show K to be in the range 0.7 to 0.9, for a wide range of rock types and compressive strengths for both chisel tooth and drag tooth operation under high unit loading. That is, loading well above the threshhold for efficient cutting. In cases where a rib can be left uncut to break into large fragments, K may be significantly less than 0.7.

To be conservative, we will set K=1. Then, equation (12) becomes simply $$P = Q_r\sigma. \tag{13}$$

To calculate the cutting rate that can be expected from an undercutting tool and its power requirement, assume that T is regulated so that:

$F_c$ = 150,000 lb.

and let V = 1 ft/sec.

Then, from equation (11), the power imparted to the teeth is:

$P_w$ = 150,000 ft-lb/sec. or $P_w$ = 273 horsepower.

Let $\sigma$ equal 5000 psi or 720,000 lb/ft², then, from equation (13), the rate of rock removal is:

$Q_r$ = 0.208 ft³/sec. or = 12.5 ft³/min.

If the slot thickness is ⅓ ft. and the slot depth is 100 ft, then every foot of advance requires the removal of 33.3 ft³ of rock. The rate of advance of the undercutting tool would then be:

Advance Rate = $Qr$/33.3 or 0.37 ft/min. or 22 ft/hr.

Assuming a hydraulic power transmission efficiency of 65%, the engine power required for slot cutting at the above rate is then 420 horse power.

Air Flow Requirement

An air flow velocity of 60 ft/sec is adequate for flushing the cuttings. The clearance area for a tool cutting a ⅓ ft thick slot is approximately 0.1 ft². The required air flow rate is then 360 c.f.m. We will assume that 360 c.f.m. is compressed in a single stage to 50 psi requiring 60 horse power.

Composite Film System

Figure 22:
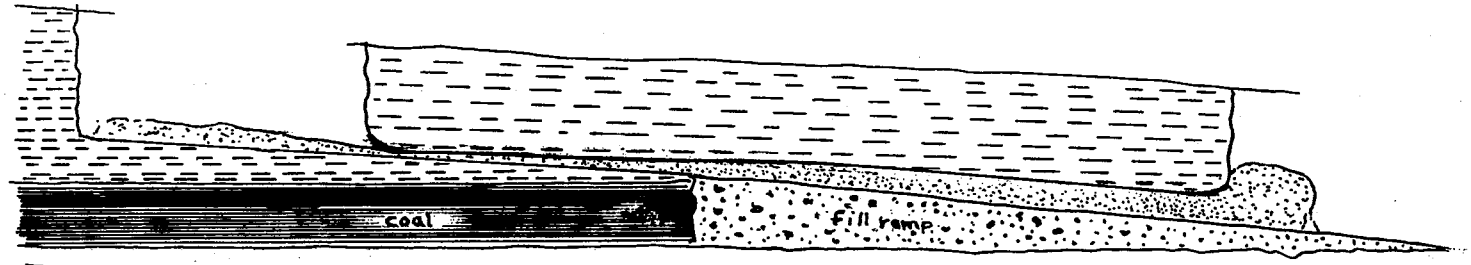
FIG. 22 is a sectional view of the block of overburden sliding a layer of clay paste off a coal deposit and onto a graded ramp of fill.
Figure 23:
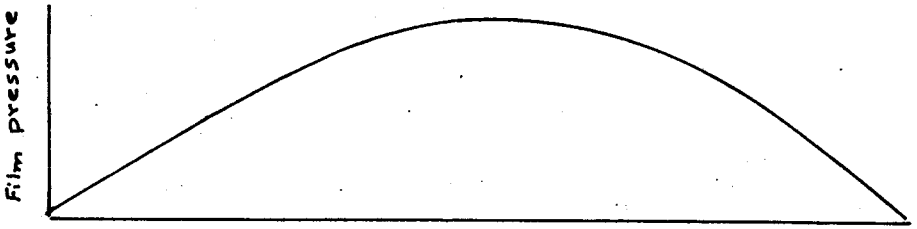
FIG. 23 shows the pressure distribution under a rigid block of overburden sliding on a homogeneous clay paste film.

In application Ser. No. 461,301, it was explained how a thick film of clay paste could provide lubrication for sliding block of overburden. The lubricating action is similar to that in a Kingsbury, tilted-pad thrust bearing. By grading the ramp with gradually increasing slope in the direction of motion, a favorable clay film thickness distribution is maintained at the front so that shearing of the film tends to maintain film thickness. If the film did not taper from the leading edge toward the rear, the paste film would lose thickness, resulting finally in lubrication failure. FIG. 22 depicts a block of overburden, in a sectional view, sliding on the paste. The thickness of the film is exaggerated. Shearing of the paste causes it to flow continuously to the rear relative to the block. At the rear corner of the block, the paste is extruded rapidly and the film near the rear of the block becomes quite thin. The increasing slope of the compacted fill ramp in front of the block helps to maintain a thick film at the forward end. FIG. 23 depicts, qualitatively, the pressure distribution under the moving block shown in FIG. 22. This hump shaped pressure distribution will obviously impose bending moments on the block tending to make the bottom surface concaved downward. Thus, the situation depicted in FIG. 22 requires that the block have both strength and reasonable rigidity. Lacking sufficient rigidity, the block might sag, reducing film thickness near the leading edge which in a short travel distance would dig into the ramp.

In very many cases, the overburden will have neither strength nor rigidity when taken in large mass. The section may contain a large percentage of soft materials and joint systems in the hard layers may give them the character of interlocked but unmortared stacks of bricks. It is, therefore, very desirable to modify the lubrication system so that flexibility and low strength in the overburden block do not threaten the lubrication process and movement of the block does not threaten its integrity. This modified system, termed herein the "composite film system", will now be discussed.

Figure 24:
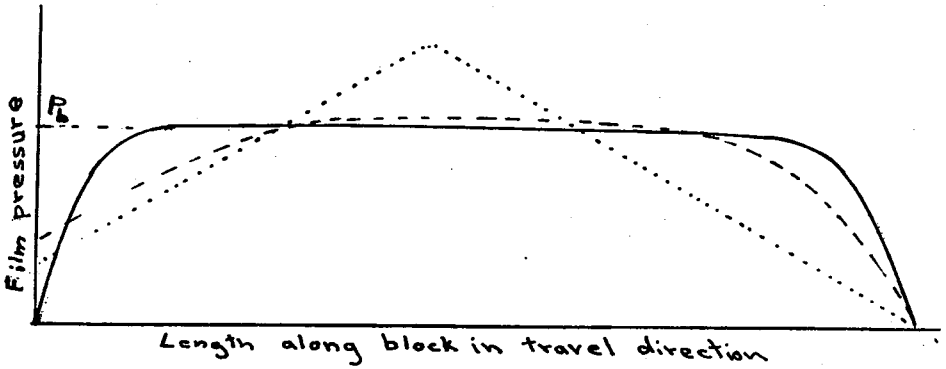
FIG. 24 shows the pressure distributions under a non-rigid block of overburden at several stages of the operation.

In FIG. 24, the pressure distribution under the block of overburden is represented for several different stages. When the paste is first injected behind the undercutter, the slot close behind the undercutter behaves like a rigid container and the pressure distribution is controlled by the flow pressure gradient. The pressure distribution along the back of the undercutting is represented by the dotted curve in FIG. 24. The vertical restraint at the advancing edge of the cut has less and less influence with increasing distance behind the undercutter and the flexibility and weight of the overburden begin to control the pressure distribution. The dashed curve represents the pressure distribution a substantial distance behind the undercutter. At mid depth in the slot, the pressure will have dropped substantially due to the upward deflection of the block. Only a few mills deflection will serve to relieve the pressure in the center region. Sag near the front of the block, if it lacks rigidity, narrows the slot thus greatly increasing resistance to flow near the front face of the block. Thus, the pressure increases steeply near the front and is fairly uniform in the interior. The solid curve in FIG. 24 represents the pressure distribution for a sliding block of overburden with a composite lubricant film. The uniformity of the pressure distribution depends on the flexibility of the block relative to clay film thickness, the more flexible the block, the more uniform the pressure in the interior and the steeper the pressure gradients near the margins.

The composite film makes use of three lubricant materials rather than a uniform paste throughout the system, as illustrated in FIGS. 26, 27, 28 and 29. One of the materials is the clay paste which, as before, is injected into the slot behind the undercutter as it advances. The second material is a low shear resistance low solids clay-water mixture. The third material is very similar to the first, a clay paste, but having substantially higher gel strength (perhaps 4 times greater) than the paste injected into the slot behind the undercutter. The three materials will be called $T_1$, $T_2$ and $T_3$, which are also the symbols for their gel strengths. $T_1$ is the paste injected into the slot behind the undercutter as it advances. $T_2$, a low solids, gelled water mix, is also injected into the slot during the slot cutting operation, but in such a way that it forms a thin film at the base of the $T_1$ material. The method for injecting the $T_2$ material will be discussed later. The $T_2$ gelled water serves its main purpose under the interior and trailing edge of the block and in the following discussion we will assume that is is absent near the leading edge. The $T_3$ high gel strength paste is desposited on the graded ramp immediately in front of the overburden block so, as the overburden moves forward, a film of this material is overridden while the surplus is dozed down the ramp by the front face of the block. The properties of the lubricant materials might be as follows:

$T_1 = 50$ lb/ft$^2$; $\eta = 0.3$ lb. sec/ft$^2$
$T_2 = 4$ lb/ft$^2$; $\eta = 8 \times 10^{-4}$ lb sec/ft$^2$
$T = 200$ lb/ft$^2$; $\eta = 1$ lb. sec/ft$^2$ Another feature of the composite film system is the creation of a convergent entrance wedge of paste at the leading edge of the block by widening the slot on its top surface. A stepped cutter 140 is mounted on top of cutter bar 16, as shown in FIGS. 1 and 25. Cutter 140 bevels the top surface of the slot at a small angle, perhaps 2° to 40°, to insure that the film near the leading edge will converge to the rear.

Yet another feature of the composite film system is that the film ramp is preferably given a uniform inclination identical to that of the slot. The block is then subject to minimum strain as it moves over the ramp.

Figure 26:
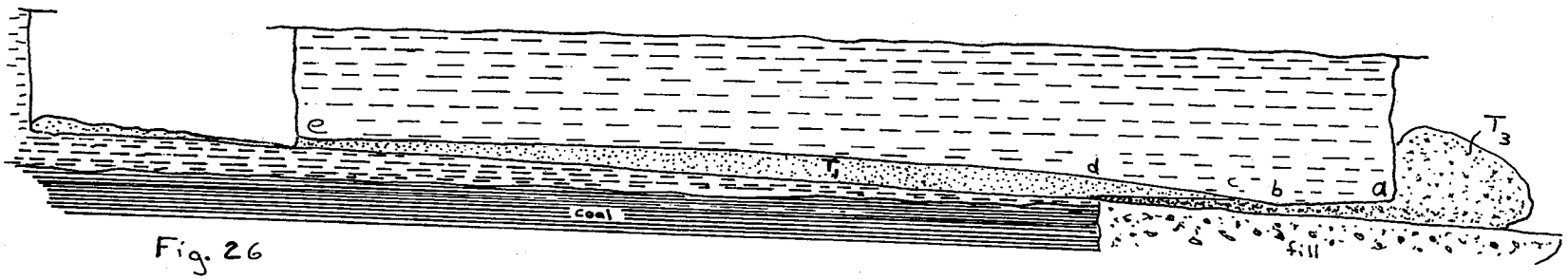
FIG. 26 shows a non-rigid block of overburden sliding on a composite lubrication system.
Figure 27:
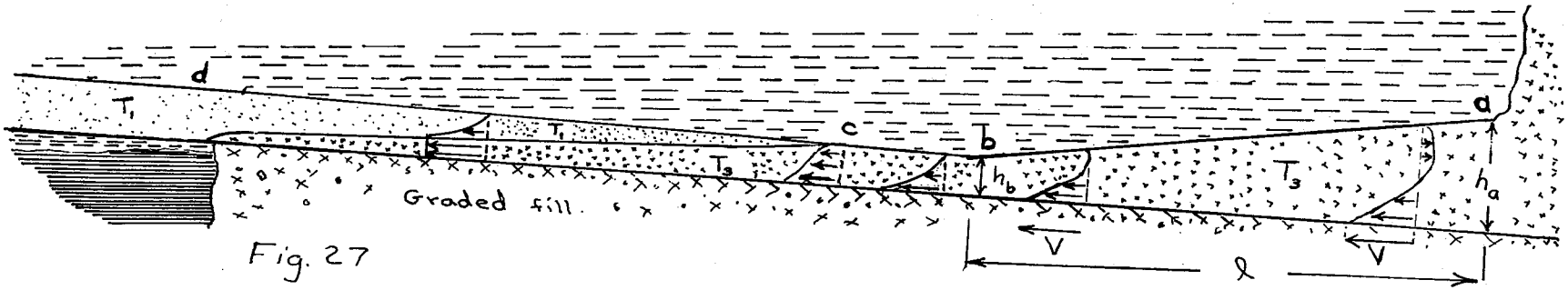
FIG. 27 shows the geometric relationship between the $T_1$ and $T_3$ pastes used with the composite lubrication system.

FIG. 26 shows the configuration of composite film materials after the block has moved a short distance down the slope. FIG. 27 is an expanded view of the film geometry near the leading edge. It is not important to have the $T_2$ material near the leading edge and it will be assumed to be asbent at the leading edge, to simplify the description. The velocity gradients drawn in FIG. 27 are from the veiwpoint of an observer moving with the block as the ground moves to the rear at velocity V. The configuration of the lubricant films changes continuously as the block moves down the incline. The $T_3$ paste extends under the block the same distance the block has travelled. In FIG. 27, the $T_3$ paste is shown to have stripped the $T_1$ paste away from the top surface to point *c*. Point *c* migrates slowly to the rear as the block travels forward. Point *b* is the back end of the tapered entry. The initial stage of block movement is most critical. At this stage, the configuration near the leading edge must insure the formation of a continuous film of $T_3$ paste. If this condition is met initially, the $T_3$ paste will widen near the leading edge as the block moves down the ramp. The film pressure must be able to build up to nearly the full overburden pressure over the length of the tapered inflow region *ab*. The pressure generated at point *b* depends on the dimensions $h_a$ and $h_b$ and $l$; the net flow paste point *b* and the gel strength $T_3$. If the flow paste point *b* were zero, the pressure at point *b* is given by:

$$P_{max} = \frac{2\,T_3 l}{h_a - h_b}\, ln\left[\frac{h_a}{h_b}\right] \tag{14}$$

$P_{max}$ is the stall pressure of the "pump" comprising the tapered inflow region *ab*. A net flow paste point *b* would result in a lower pressure.

Equation (14) may be used to select a configuration near to leading edge of the block that will insure continuous film lubrication. This is done simply by selecting values for $h_a$, $h_b$, $l$ and $T_3$ so that $P_{max}$ is substantially greater than the average overburden pressure. If the overburden were 100 ft. thick, then the overburden pressure $P_b$ would be approximately 14,000 lb/ft$^2$. $P_b$ is the maximum back pressure that could be applied at point *b* due to clay film pressure in the interior. Then, if $P_{max} > P_b$, there will be a net flow past point *b* and a continuous film of $T_3$ paste is maintained.

As an example, let $h_a = 0.05$ ft.,
$h_b = 0.35$ ft.,
$l = 8$ ft. and
$T_3 = 200$ lb/ft$^2$.

Figure 29:
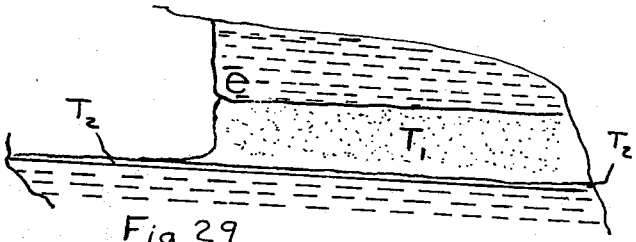
FIG. 29 shows retention of $T_1$ paste near the trailing edge when the shear zone lies within the low shear resistance $T_2$ film under the $T_1$ layer.
Figure 28:
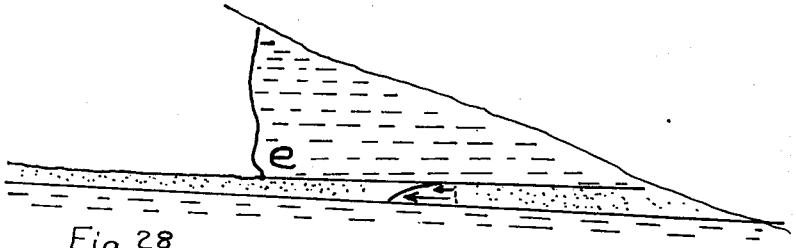
FIG. 28 shows expulsion of $T_1$ paste at the trailing edge.

Then, from equation (14), $P_{max} = 20{,}700$ lb/ft$^2$ and therefore
$P_{max} > P_b$ The $T_2$ gelled water is not essential to the effective operation of the composite film lubrication system. However, if it is present, it has the effect of preserving a much wider $T_1$ film during block motion. If the $T_2$ material is absent, shearing of the $T_1$ film causes it to flow to the rear as the block moves forward. The substantial net flow out from under the trailing edge as indicated in FIG. 28 is accompanied by a thinning of the entire film. If, on the other hand, the low shear resistant $T_2$ material is present at the base of the $T_1$ film, nearly all the shearing action takes place in the thin $T_2$ layer and the $T_1$ material moves along with the block as indicated in FIG. 29.

The main advantage of the composite film lubrication system is its ability to function efficiently when absence of strength and rigidity in the overburden imposes a uniform film pressure distribution in the interior of the block. A related advantage is its ability to operate on a uniform slope so the block is not subject to any deformations other than those arising from variations in film thickness. Another advantage which favors the integrity of the block is the fact that drag will be greatest near the leading edge. This places the block slightly in compression in the direction of motion. This effect is small but, since the tensile strength of the overburden is likely to be very small, the slight compression could be significant.

Figure 30:
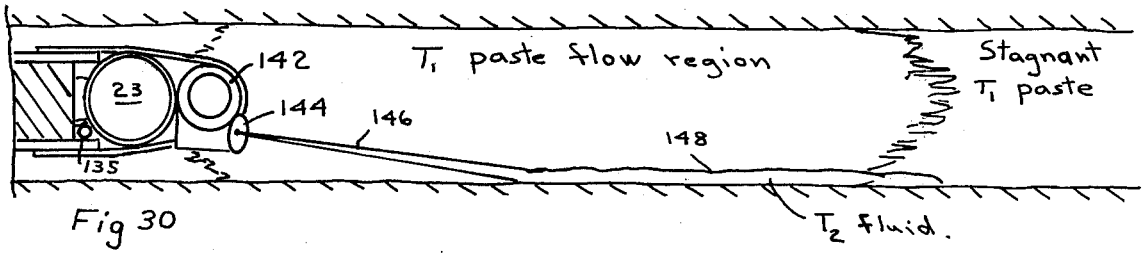
FIG. 30 is a transverse section through the trailing edge of the guide assembly and the slot behind the guide assembly showing $T_2$ fluid injected into the base of the $T_1$ paste by means of a high velocity jet pulse.
Figure 31:
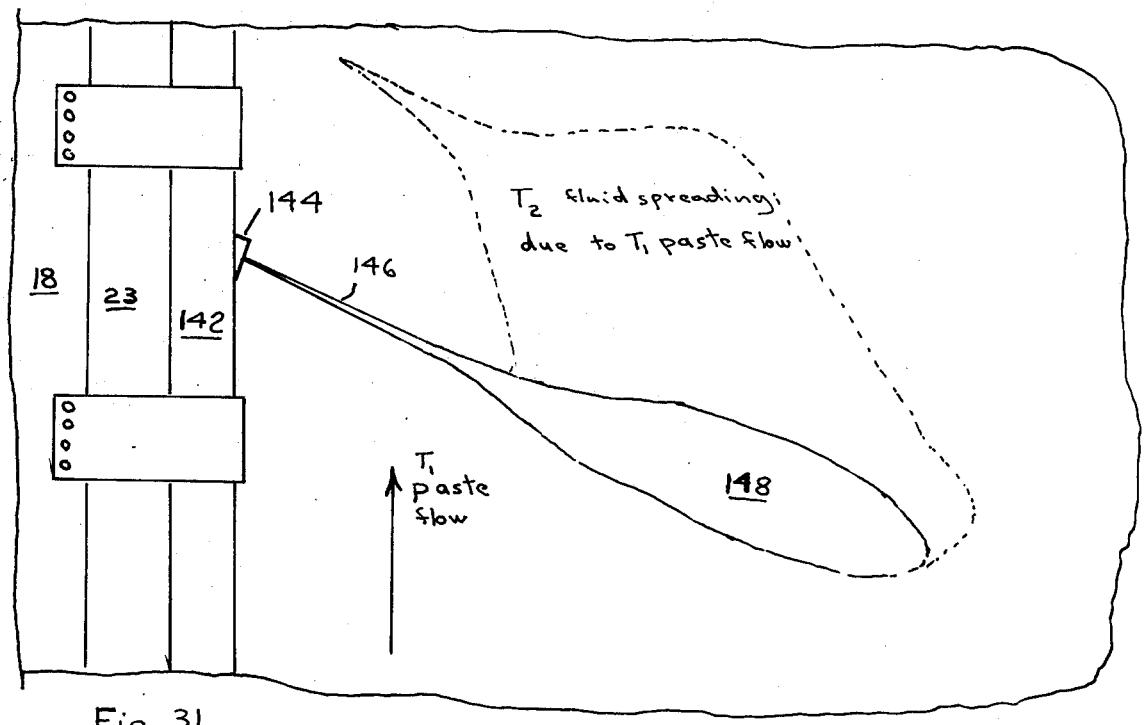
FIG. 31 shows, in top view, a portion of the guide assembly trailing edge and the slot behind the trailing edge with a slug of fluid being injected into the base of the slot and the spreading action on the injected fluid due to the motion of the $T_1$ paste.

FIG. 30 is a section through the trailing edge of guide assembly 18, showing passage 23 used to convey the $T_1$ paste into the slot and behind 23 a second tubular passage 142. Nozzles 144 are connected to passage 142 at several locations along its length. Tube 142 will extend deeper into the slot than passage 23, as shown in FIG. 2, with one or more nozzles 144 located deeper in the slot than paste injection point or clay entry 24. Nozzles 144 are situated so as to direct a high velocity jet 146 toward the rear and slightly downward, as shown in FIG. 30. FIG. 31 is a top view showing a segment of the trailing edge and also showing one of the nozzles 144 projecting high velocity jet 146 to the rear and angled up stream relative to the flow of $T_1$ paste along the trailing edge.

The jet 146 is preferably of very short duration and high velocity with long intervals of time between pulses. As an example, a $\frac{1}{8}$ inch jet might issue from the nozzle at 700 ft. per second in a pulse of one fourth sec. duration with a 20 sec. interval between pulses. The interval between pulses would be used to store fluid in a high pressure accumulator for periodic release through nozzles 144.

In traveling through paste, the jet follows a gradually diverging channel which fans out on the lower slot surface coming to rest as elongate lenticular mass 148. In its transit through the $T_1$ paste, the jet, which may be plain water to start with, entrains some of the $T_1$ paste to form a mixture having a much lower solids content than the $T_1$ paste. It is this new mixture that we refer to as the $T_2$ fluid. The $T_2$ composition can be controlled to some degree by adjusting the duration of the pulse, the longer the pulse the lower the solids content of the $T_2$ material.

The lens 148 of $T_2$ material does not remain static because it lies within the shear zone at the base of the continuously flowing $T_1$ paste. The $T_2$ material becomes spread out in the direction of $T_1$ paste movement as it moves parallel to the cutting assembly. Reasonable coverage of the base of the slot by the $T_2$ material can thus be obtained with a small number of widely spaced nozzles 144.

While specific examples have been set forth herein and specific components and elements illustrated, it is to be understood that variations and modifications thereof will be apparent to one skilled in the art. Accordingly, such variations and modifications are to be considered part of the present invention and the invention is to be limited only in accordance with the appended claims.

What is claimed is:

1. Apparatus for cutting in earth formations a deep slot having a large depth to thickness ratio comprising; a long support means disposed adjacent the advancing edge of the slot and extending from outside the slot to its full depth; cutting means guided on the forward side of said support; a passage extending the full length of the support adapted to discharge a fluid into said forward clearance to flush material from the slot; a second passage extending from outside the slot along the support to an intermediate depth for discharging paste mixture into the excavated region at the rear under pressure which acts on the sides of the slot preventing the slot from closing on the support and which acts on the rearward facing area of thes support providing the force required to move the support forward against the advancing edge of the slot; projections on the forward portion of said support making close contact with both sides of the slot to its full depth so as to prevent the flow of paste mixture from the excavated region at the rear of the support into the forward clearance; and motive means coupled to the outer end of said support supplying guidance and control to the support, supplying paste and fluid under pressure to said passages, and supplying energy to said cutting means.

2. Apparatus in accordance with claim 1 with a deflection sensing means extending more than half the length of the support capable of signaling in response to deflections in the support.

3. Apparatus in accordance with claim 2 wherein the deflection sensing means is a slender elongate transducer means disposed under tension in a passage filled with a fluid matching the density of the tranducer thus placing the transducer in a simulated weightless condition.

4. Apparatus in accordance with claim 3 where the elongate transducer means carries a plurality of switch elements spaced along its length which activate appropriate control circuits when a portion of the support reaches a certain degree of deflection.

5. Apparatus in accordance with claim 1 which additionally includes control means mounted in the support to adjust the volume of liquid solids mixture discharged on each side of said support in response to a control signal.

6. Apparatus in accordance with claim 5 wherein the control means includes a pump means for transferring the mixture disposed in the spaces on each side of the support from one side to the other in a direction appropriate to a control signal.

7. Apparatus in accordance with claim 1 wherein the liquid solids mixture transmitted by said second passage is a thick paste of clay, water, and mineral refuse.

8. Apparatus in accordance with claim 7 wherein a means for introducing an annular boundary film of low shear resistance liquid around the paste is connected to the inlet of the passage to facilitate to flow of paste through the paste.

9. Apparatus in accordance with claim 8 wherein the means for introducing the boundary film comprises an extrusion nozzle whose throat cross section is smaller than the passage and a means for injecting a low shear resistance liquid into the passage adjacent the down stream side of the nozzle throat.

10. Apparatus in accordance with claim 1 wherein the cutting means is a reciprocating cutter bar with a plurality of spaced pivoting cutters.

11. Apparatus in accordance with claim 10 wherein the cutter bar mounts a bevel cutting means projecting into the slot entrance.

* * * * *